US006310592B1

(12) United States Patent
Moon et al.

(10) Patent No.: US 6,310,592 B1
(45) Date of Patent: Oct. 30, 2001

(54) LIQUID CRYSTAL DISPLAY HAVING A DUAL BANK DATA STRUCTURE AND A DRIVING METHOD THEREOF

(75) Inventors: Hoi-Sik Moon; Dong-Won Park, both of Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/221,174

(22) Filed: Dec. 28, 1998

(51) Int. Cl.[7] ..... G09G 3/36

(52) U.S. Cl. ..... 345/87; 345/89; 345/90; 345/92

(58) Field of Search ..... 345/87, 89, 90, 345/92, 98, 100

(56) References Cited

U.S. PATENT DOCUMENTS 5,604,511 * 2/1997 Ohi ..... 345/98
5,796,379 * 8/1998 Enomoto et al. ..... 345/89
5,808,596 * 9/1998 Kim ..... 345/98
5,945,970 * 8/1999 Moon et al. ..... 345/92

* cited by examiner

*Primary Examiner*—Richard Hjerpe
*Assistant Examiner*—Kimnhung Nguyen
(74) *Attorney, Agent, or Firm*—Howrey Simon Arnold & White, LLP

(57) ABSTRACT

Disclosed is a liquid crystal display having a dual bank data driver structure and a driving method thereof. The liquid crystal display includes an LCD panel including a plurality of gate lines, a plurality of adjacent data line groups having an even number of data lines disposed on the LCD panel intersecting the gate lines, and a plurality of pixels arranged in a matrix and each having a switching element connected to the gate lines and the data lines; a gate driver successively applying gate ON voltage to the gate lines to turn on the switching elements; and first and second data drivers provided on opposing sides of the LCD panel and to which the data line groups are alternately connected, the first and second data drivers applying grey voltage corresponding to color signals to the data lines via output terminals. The method of driving the LCD includes the steps of applying gate ON voltage successively to the gate lines, and applying grey voltage to the data lines in units of lines through the first and second data drivers.

2 Claims, 12 Drawing Sheets

LIQUID CRYSTAL DISPLAY HAVING A DUAL BANK DATA STRUCTURE AND A DRIVING METHOD THEREOF

BACKGROUND OF THE INVENTION (a) Field of the Invention

The present invention relates to a liquid crystal display (LCD), and more particularly to a LCD having a dual bank data driver structure and a driving method thereof.

(b) Description of the Related Art

The LCD is increasingly being used for the display device in televisions, personal computers and various other consumer appliances. The superior qualities of the LCD, such as low power consumption, thin profile, high resolution, light weight, etc., makes it be a future substitute for the traditional CRT displays.

LCDs apply an electric field to liquid crystal material of anisotropic dielectricity injected between two substrates to form a liquid crystal layer. The two substrates are arranged substantially parallel to one another having a predetermined gap therebetween, and the amount of light permeating the substrates is controlled by the intensity of the electric field applied to the liquid crystal material.

The LCD typically comprises a LCD panel including two substrates on which are formed a plurality of gate lines and data lines, a switching transistor and a pixel defined by the intersection of the gate lines and data lines. The LCD also comprises a gate driver that turns on each of the gate lines in sequence by applying a scanning signal; and a data driver (also called a source driver) that applies grey voltage corresponding to color signals to the data lines of the LCD panel in units of lines. The data driver and the gate driver are comprised of a plurality of data driver ICs and gate driver ICs, respectively.

If the electric field is applied to the liquid crystal layer, in the same direction continuously, the liquid crystal tends to degrades. Accordingly, image signals must be driven alternately between positive and negative values. Such a drive method is called an inversion driving method. Among the different types of the inversion driving methods, a frame inversion method inverts the image signals in units of frames, a line inversion method inverts the image signals in units of lines, and a dot inversion method inverts the image signals in units of pixels. When using a frame inversion method or a line inversion method, however, it is difficult to attain an optimal picture quality because of crosstalk and flicker problems.

Accordingly, a method recently used alternates the polarity of an image signal for common electrode voltage, supplied from the data driver ICs, between a positive polarity (+) and a negative polarity (−) in units of pixels. In more detail, after arranging the data driver ICs in a row on one of the two substrates of the LCD panel and electrically connecting a data line to an output terminal of each of the data driver ICs (hereinafter referred to as a single bank structure), a grey voltage output from each of the output terminals of the data driver ICs is controlled to change from positive to negative while being applied to the data lines, thereby alternating the polarity of the pixels from positive to negative.

In addition to the above typical single bank structure LCD, there has been developed a dual bank structure LCD in which data driver ICs are arranged on both the upper and lower substrates of the LCD panel. In the dual bank structure, odd (or even) data lines are connected to upper data driver ICs and even (or odd) data lines are connected to lower data driver ICs. However, with the dual bank structure LCD, as with the single bank structure LCD, if grey voltage output from the output terminals of the data drive ICs is applied to the data lines alternating from positive to negative, polarities of the pixels are inverted in (+)(+) and (−)(−) cycles. As a result, full dot inversion is not realized.

SUMMARY OF THE INVENTION

The present invention has been made in an effort to solve the above problems.

It is an object of the present invention to provide an LCD having a dual bank data driver structure realizing dot inversion and a driving method thereof.

To achieve the above object, the present invention provides an LCD having a dual bank data driver structure and a driving method thereof. The LCD includes an LCD panel including a plurality of gate lines, a plurality of data lines intersecting the gate lines, and a plurality of pixels arranged in a matrix and each having a switching element connected to the gate lines and the data lines, wherein the data lines are grouped into a plurality of data line groups and each data line group has an even number of adjacent data lines; a gate driver successively applying gate ON voltage to the gate lines to turn on the switching elements; and first and second data drivers provided on opposing sides of the LCD panel and to which the data line groups are alternately connected, the first and second data drivers applying grey voltages corresponding to image signals to the data lines via output terminals.

According to the present invention, the LCD further includes a timing signal generator for outputting timing signals to the first and second data drivers, and to the gate driver.

Another feature of the present invention is that the grey voltage is output at opposite polarities for adjacent output terminals of the first and second data drivers.

According to the present invention, each data line group is comprised of a pair of adjacent data lines.

According to the present invention, the timing signal generator includes a first divider receiving the R,G,B data input in series, and outputting a first R,G,B data each corresponding to odd R,G,B data among the R,G,B data and a second R,G,B data corresponding to even R,G,B data among the R,G,B data; a second divider receiving the first and second R,G,B data, and outputting a third R,G,B data corresponding to every other first R,G,B data beginning with a first of the same, a fourth R,G,B data corresponding to every other first R,G,B data beginning with a second of the same, a fifth R,G,B data corresponding to every other second R,G,B data beginning with a first of the same, and a sixth R,G,B data corresponding to every other second R,G,B data beginning with a second of the same; and a data selector for selectively outputting the third, fourth, fifth and sixth R,G,B data output from the second divider to the first and second data drivers, and which applies grey voltage to the data lines of the LCD panel such that grey voltage of opposite polarity is applied to adjacent data lines.

The method of driving the LCD according to the present invention includes the steps of applying gate ON voltage successively to the gate lines, and applying grey voltage to the data lines in units of lines through the first and second data drivers.

According to the present invention, the step of applying grey voltage to the data lines further includes the steps of receiving the R,G,B data input in series; outputting a first R,G,B data corresponding to odd R,G,B data among the R,G,B data and a second R,G,B data corresponding to even R,G,B data among the R,G,B data; receiving the first and second R,G,B data, and outputting a third R,G,B data corresponding to every other first R,G,B data beginning with a first of the same, a fourth R,G,B data corresponding to every other first R,G,B data beginning with a second of the same, a fifth R,G,B data corresponding to every other second R,G,B data beginning with a first of the same, and a sixth R,G,B data corresponding to every other second R,G,B data beginning with a second of the same; and selectively outputting the third, fourth, fifth and sixth R,G,B data to the first and second data drivers, and applying grey voltage to the data lines of the LCD panel such that grey voltage of opposite polarity is applied to adjacent data lines.

BRIEF DESCRIPTION OF THE DRAWINGS

The accompanying drawings illustrate an embodiment of the invention, and, together with the description, serve to explain the principles of the invention.

DETAILED DESCRIPTION OF THE PREFERRED EMBODIMENTS

A preferred embodiment of the present invention will now be described in detail with reference to the accompanying drawings.

Figure 1:
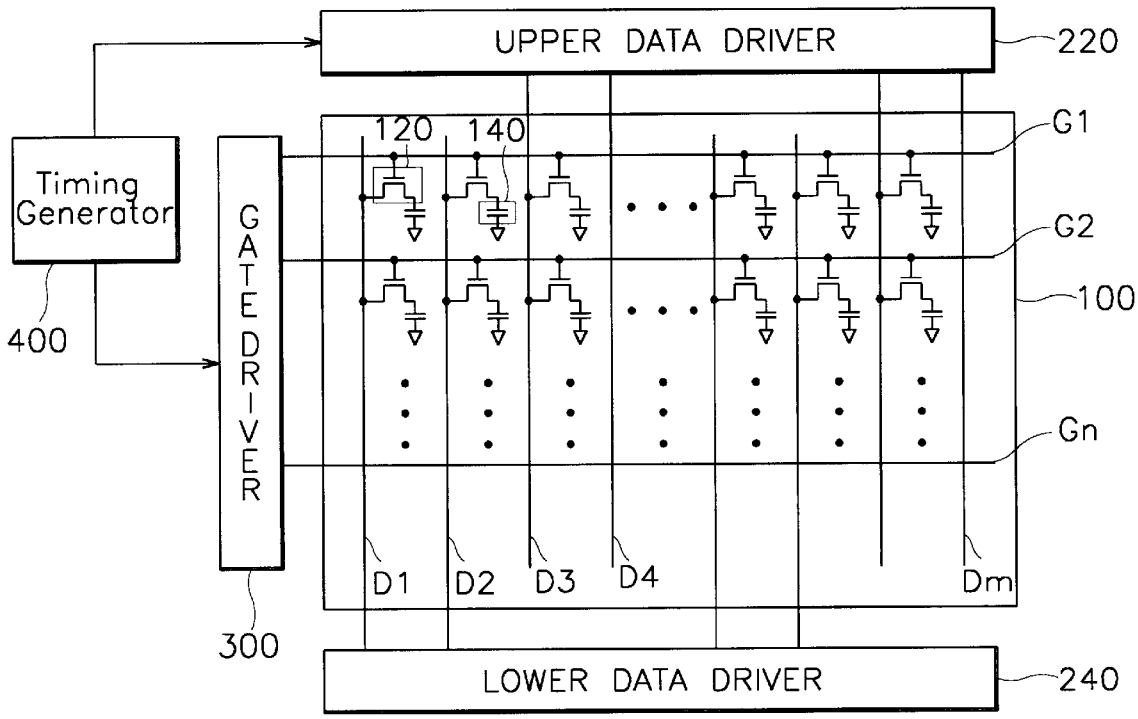
FIG. 1 is a block diagram of a LCD according to a preferred embodiment of the present invention.

FIG. 1 shows a block diagram of an LCD according to a preferred embodiment of the present invention. As shown in the drawing, the LCD of the present invention comprises an LCD panel 100, upper and lower data drivers 220 and 240, a gate driver 300, and a timing generator 400. A plurality of gate lines (G1, G2 . . . Gn) are arranged in parallel on the LCD panel 100, and a plurality of data lines (D1, D2 . . . Dm) are provided intersecting the gate lines. The data lines intersect the gate lines with a substantial perpendicularity. A plurality of matrix type pixels are defined by the intersection of the gate lines and the data lines, and a thin film transistor (TFT) 120, which functions as a switching element, and a liquid crystal capacitor 140 are formed at each of the pixels.

The gate driver 300 successively applies gate ON voltage, acting as scanning signals, to each gate line. The upper data driver 220 and lower data driver 240 respectively apply grey voltage corresponding to image signals to the data lines on upper and lower substrates of the LCD panel 100 in units of lines. In the present invention, as can be seen in the drawing, the data lines are alternately connected electrically to the upper data drivers 220 and lower data driver 240 in pairs. For example, the two consecutive data lines (D1 and D2) are connected to the lower data driver 240 and the subsequent consecutive data lines (D3 and D4) are connected to the upper data driver 220. This pattern continues for all the data lines. Here, each of the upper and lower data drivers 220 and 240 alternately outputs positive (+) and negative (−) grey voltage.

The timing signal generator 400 receives R,G,B data and synchronization signals from a graphic controller (not shown). After conducting a predetermined signal processing operation on the R,G,B data, the timing generator 400 transmits the processed R,G,B data to the upper data driver 220 and lower data driver 240, and transmits required timing signals to the gate driver 300 and the data drivers 220 and 240. The upper data drivers 220 and lower data driver 240 output the received R,G,B data as signals with repeating (+), (−) polarities to the data lines. Accordingly, the dual bank LCD is driven using a dot inversion method.

The operation of the dual bank LCD of the present invention will be described in detail hereinbelow.

Figure 2:
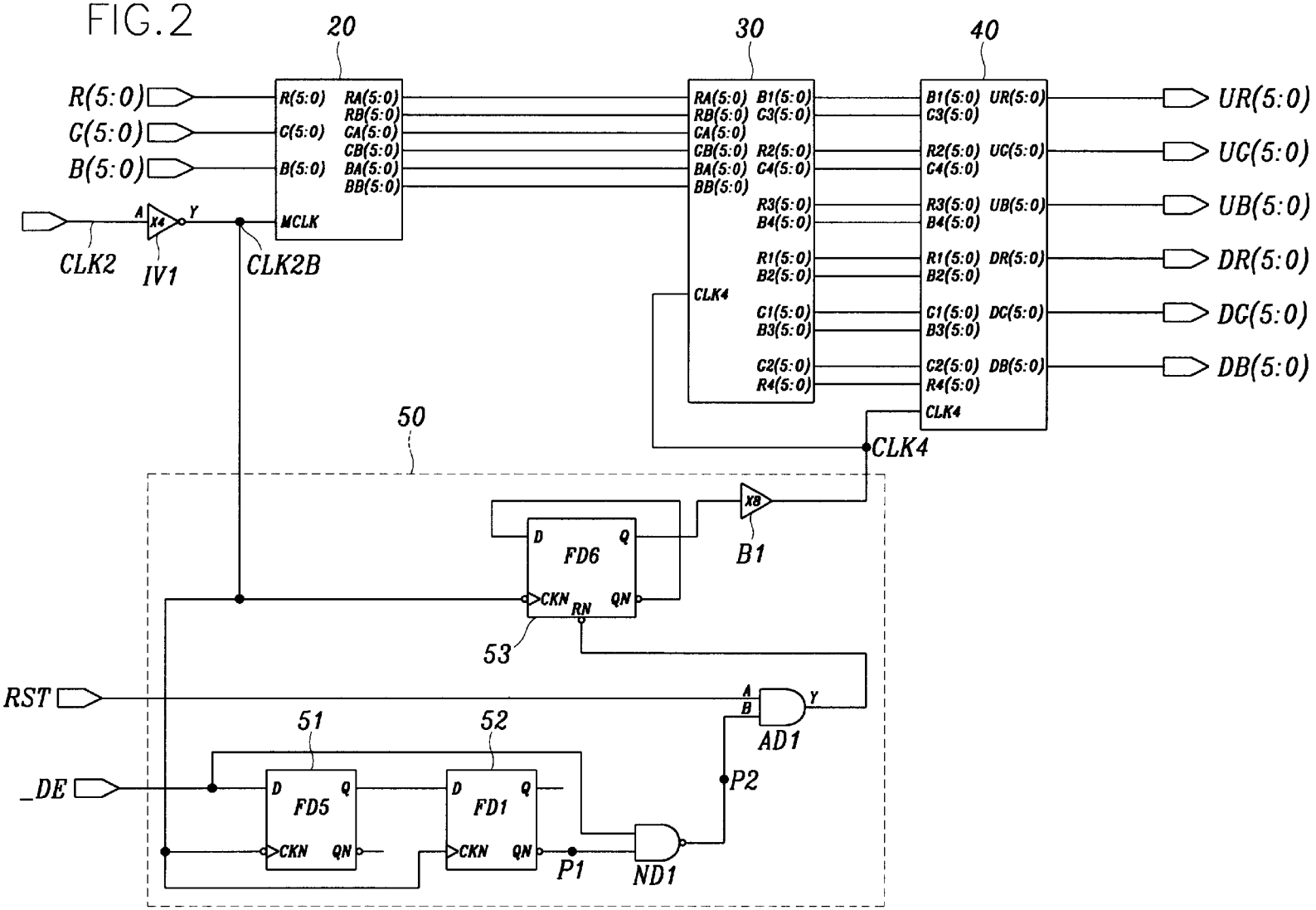
FIG. 2 is a block diagram of a timing signal generator shown in FIG. 1.

FIG. 2 is a block diagram of the timing signal generator 400 shown in FIG. 1. As shown in the drawing, the timing signal generator 400 comprises a first divider 20 receiving R,G,B data and divides the R,G,B data by 2 according to a first clock signal CLK2B; a clock divider 50 receiving a reset signal RST, a data enable signal DE and the first clock signal CLK2B, and outputting a second clock signal CLK4 which divides the first clock signal CLK2B by 2; a second divider 30 for dividing the data from the first divider 20 by 2 according to the second clock signal CLK4; and a data selector 40 which pairs the data divided by the second divider 30 and inverts each pair of adjacent data, then outputs the same.

Figure 3:
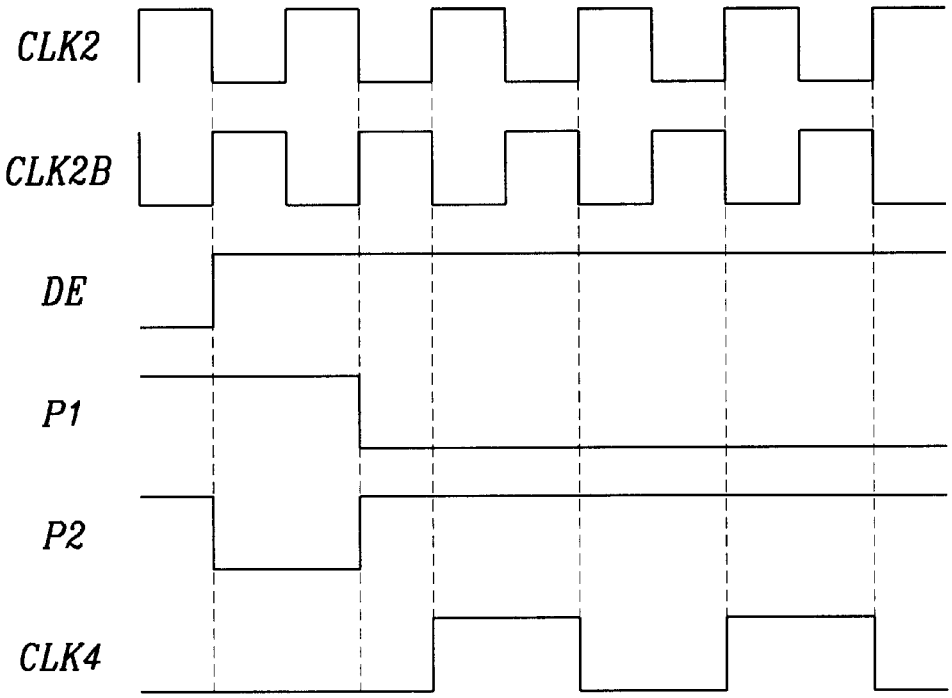
FIG. 3 is a timing chart of a clock divider shown in FIG. 2.

Regarding the operation of the timing signal generator 400, the first clock signal CLK2B and the R(5:0), G(5:0), B(5:0) data of 6 bits, corresponding to the timing chart of FIG. 3, are input to the first divider 20. Next, the first divider 20 divides each of the R,G,B data according to the first clock signal CLK2B and outputs them. Here, the first clock signal CLK2B is an inverted signal of a clock signal CLK2 which divides a main clock signal by 2.

Figure 4A:
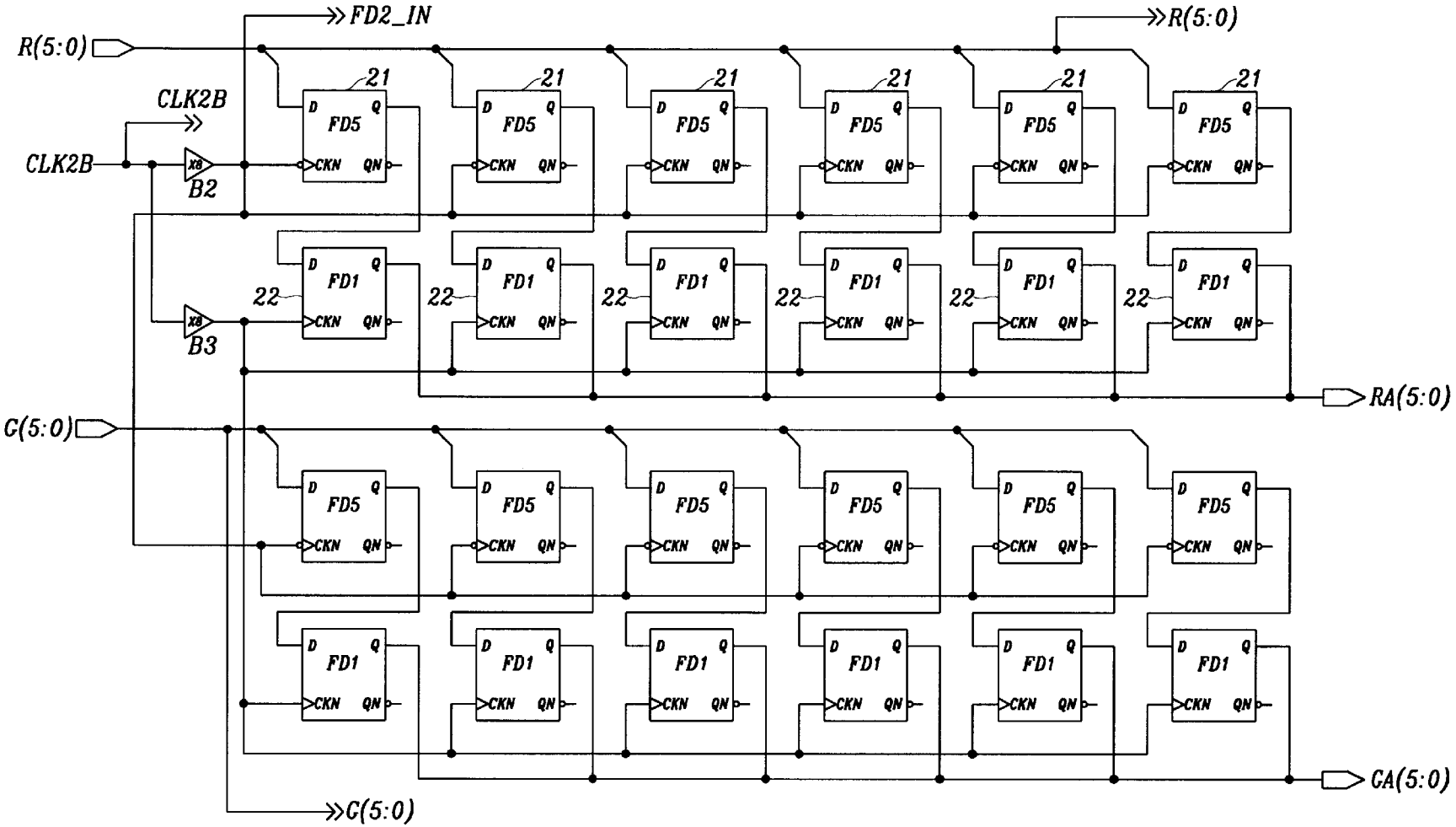
FIGS. 4A and 4B are detailed views of a first divider shown in FIG. 2.
Figure 4B:
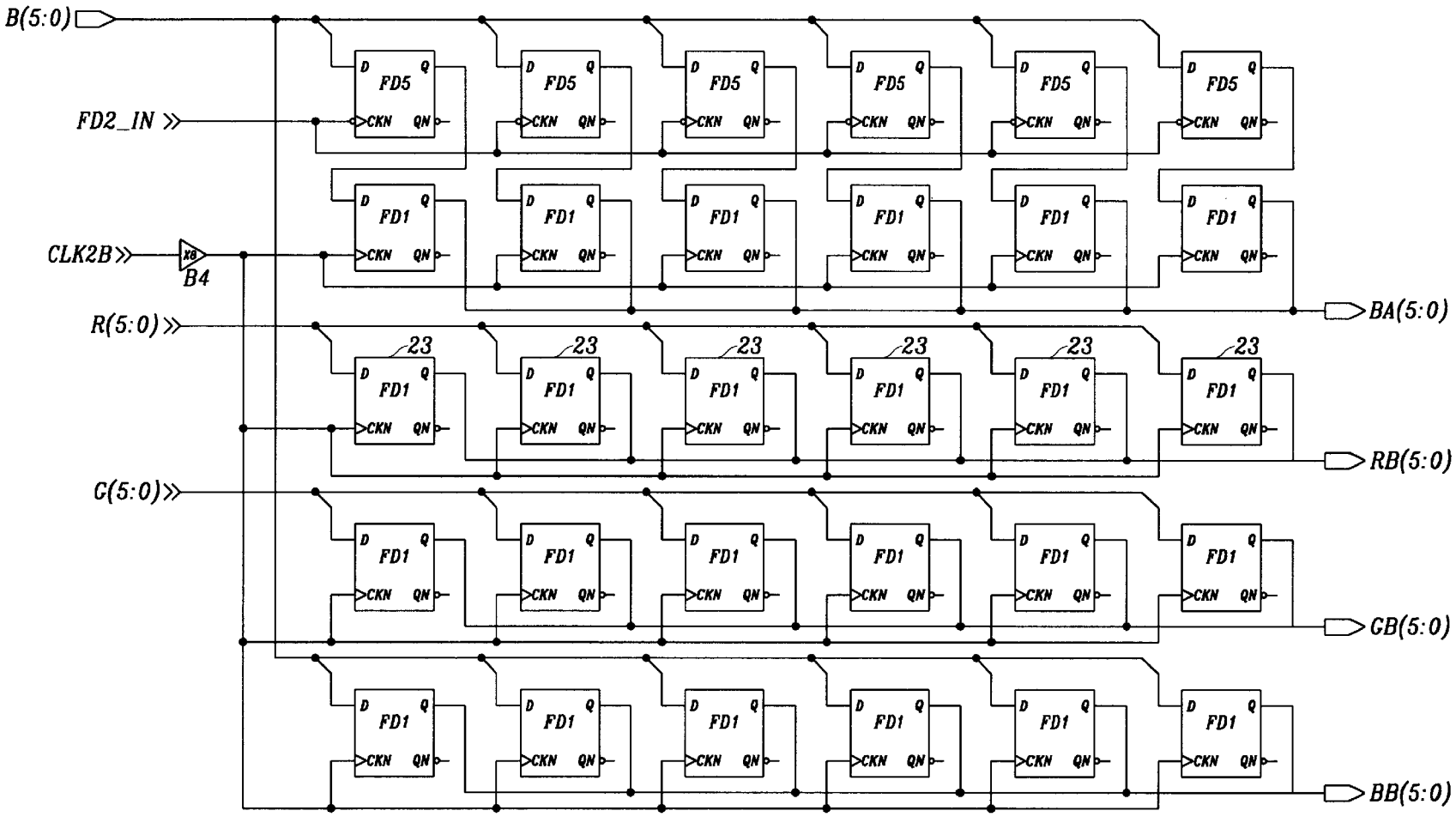

FIGS. 4A and 4B show detailed views of the first divider 20 of FIG. 2. As shown in the drawings, the first divider 20 comprises a plurality of first flip flops 21 for outputting data RA(5:0), GA(5:0) and BA(5:0) corresponding to odd R,G,B data, respectively, at a falling edge of the first clock signal CLK2B; a plurality of second flip flops 22 for outputting the output of the first flip flops 21 at a rising edge of the first clock signal CLK2B; and a plurality of third flip flops 23 for outputting data RA(5:0), GA(5:0) and BA(5:0) corresponding to even R,G,B data, respectively, at the rising edge of the first clock signal CLK2B.

Figure 5:
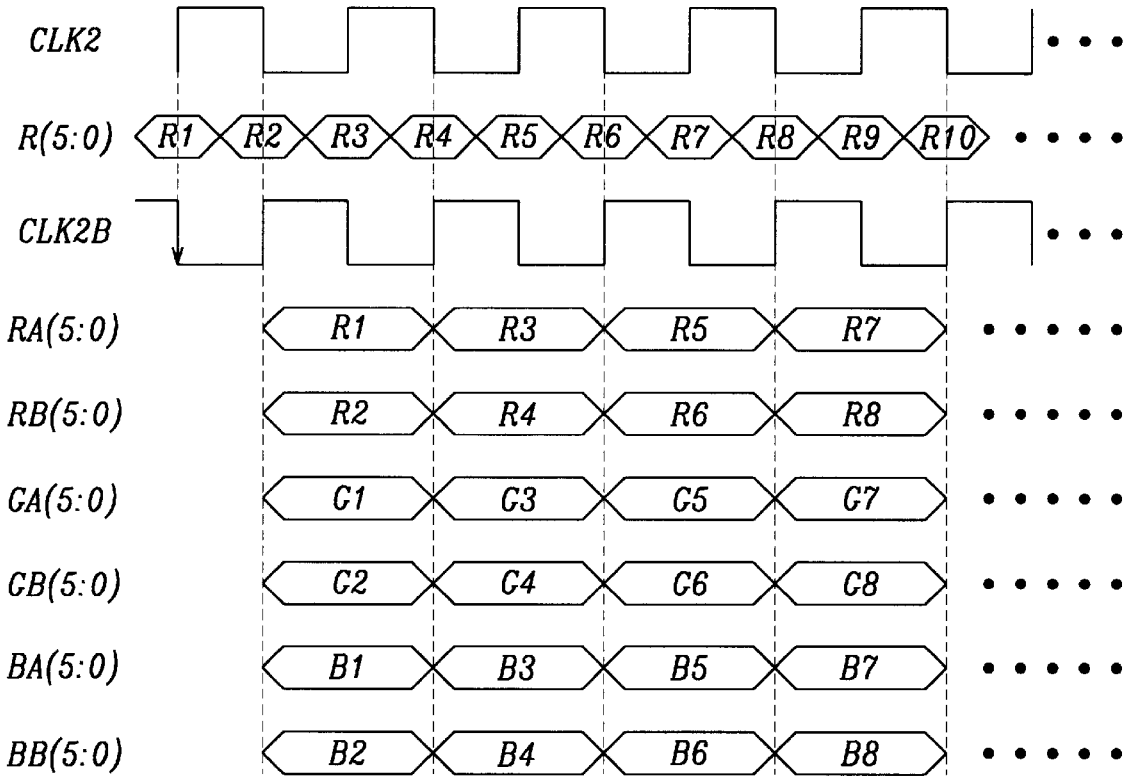
FIG. 5 is a timing chart of each element of FIGS. 4A and 4B.

In FIGS. 4A and 4B, the odd data RA(5:0), among the R(5:0) data, is transmitted from the first flip flops 21 to the second flip flops 22 at the falling edge of the first clock signal CLK2B, and the data transmitted to the second flip flops 22 is output at the rising edge of the first clock signal CLK2B. This is illustrated in the timing chart of FIG. 5. G(5:0) and B(5:0) data is divided using the same method.

The first flip flops 21 output data at the falling edge of the first clock signal CLK2B, while the second and third flip flops 22 and 23 output data at the rising edge of the first clock signal CLK2B. Further, the above description of the first divider 20 is only one example, and it is possible to make suitable changes to the circuitry of the same.

As shown in FIG. 2, the first clock signal CLK2B, which is inverted in an inverter IV1, is also fed into the clock divider 50. The clock divider 50 divides the first clock signal CLK2B by 2 and outputs it as the second clock signal CLK4. The clock divider 50 will be described in more detail hereinbelow.

Referring to FIG. 2, the clock divider 50 comprises a first flip flop 51 which receives a data enable signal DE as an input signal and the first clock signal 2B as a clock signal, and outputs the data enable signal DE at the rising edge of the first clock signal CLK2B; a second flip flop 52 which receives the output signal of the first flip flop 51, uses the first clock signal CLK2B as a clock signal, and inverts the output signal of the first flip flop 51 and outputs the same at the falling edge of the first clock signal CLK2B; a NAND gate ND1 for performing a NAND operation on the data enable signal DE and the output signal of the second flip flop 52; an AND gate AD1 for performing an AND operation on output signals of the NAND gate ND1 and a reset signal RST, and outputting resulting signals; and a third flip flop 53 receiving output of the AND gate AD1 as a reset, receiving an inverted output signal as an input signal D, receiving the first clock signal CLK2B as a clock signal, and which divides the first clock signal CLK2B by 2 and outputs the same.

According to the present invention, the third flip flop 53 outputs data at the falling edge of the first clock signal CLK2B, and has a reset terminal. The reset signal RST of FIG. 2, as a conventional reset signal, is in a low state only when changing a line, and remains in a high state during the remainder of the time. The operation of the clock divider 50 will now be described. The data enable signal DE is input as data of the first flip flop 51, and the first clock signal CLK2B is input as a clock. Accordingly, the data enable signal DE is delayed one clock in the first flip flop 51, and is again delayed by one more clock in the second flip flop 52, inverted and output as P1. P1 has a waveform as shown in FIG. 3. As a result, this waveform, together with the data enable signal DE, is NAND operated in the NAND gate ND1 and output, thereby producing an output point P2 having a waveform as shown in FIG. 3.

Next, an output signal of the NAND gate ND1 is input to the reset terminal of the third flip flop 53 which outputs data at the falling edge of the first clock signal CLK2B and is reset. The waveform of the second clock signal CLK4 is as shown in FIG. 4. Subsequently, the second clock signal CLK4 is input to the second divider 30 which divides by 2 the output RA(5:0), RB(5:0), GA(5:0), GB(5:0), BA(5:0) and BB(5:0) which is output from the first divider 20. This will be described in more detail with reference to FIGS. 6 and 7.

Figure 6:
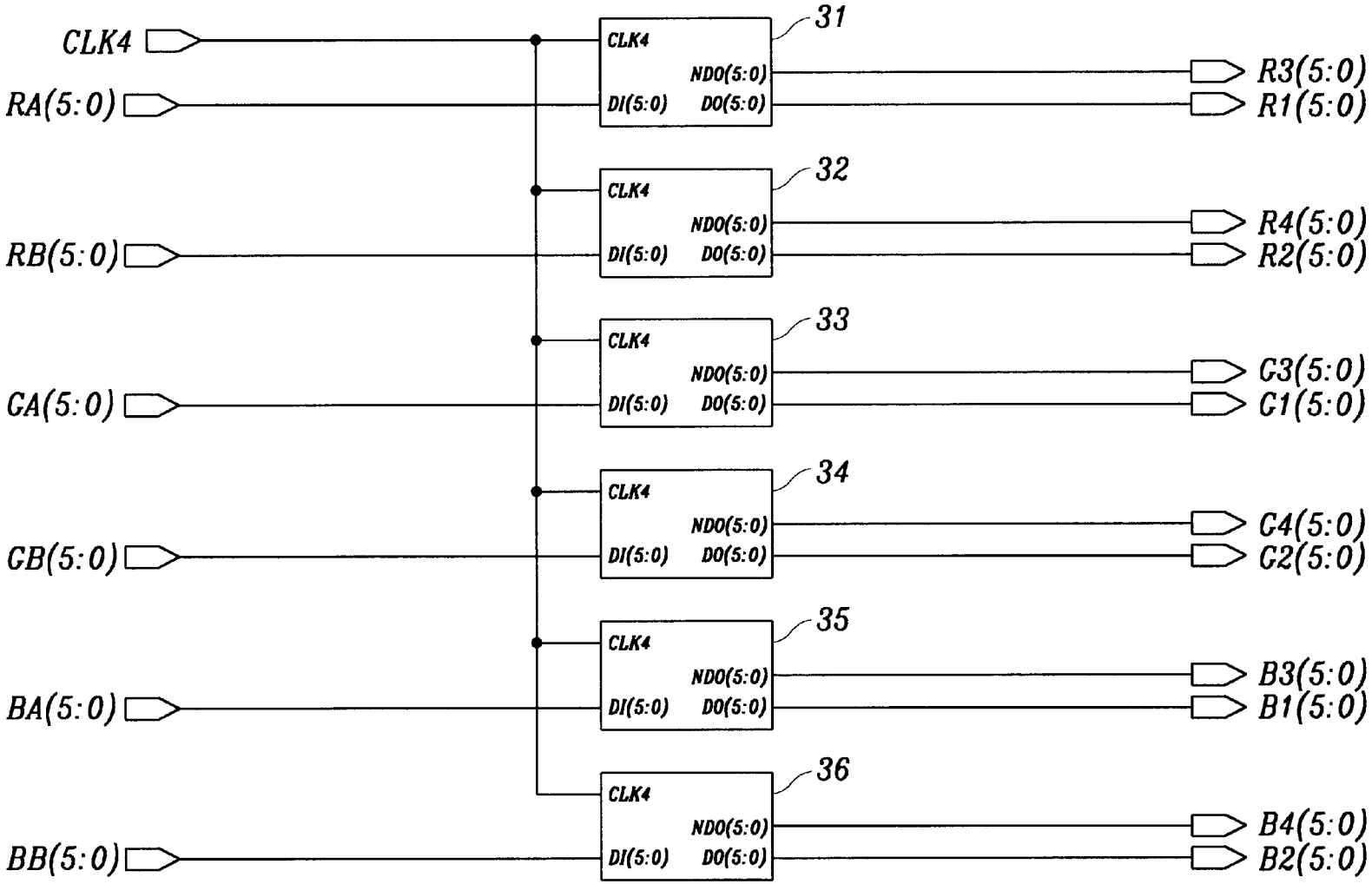
FIG. 6 is a detailed view of a second divider shown in FIG. 2.

As shown in FIG. 6, the second divider 30 is comprised of six(6) sub-dividers 20 31, 32, 33, 34, 35 and 36. Each of the sub-dividers 31, 32, 33, 34, 35 and 36, as shown in FIG. 7, includes a first flip flop 91 which outputs at the rising edge of the second clock signal CLK4 data R1(5:0), R2(5:0), G1(5:0), G2(5:0), B1(5:0) and B2(5:0) corresponding to odd data among the data RA(5:0), RB(5:0), GA(5:0), GB(5:0), BA(5:0) and BB(5:0) output from the first divider 20; a second flip flop 92 for outputting at the falling edge of the second clock CLK4 data R1(5:0), R2(5:0), G1(5:0), G2(5:0), B1(5:0) and B2(5:0) output from the first flip flop 91; and a third flip flop 93 for outputting at the falling edge of the second clock signal CLK4 data R3(5:0), R4(5:0), G3(5:0), G4(5:0), B3(5:0) and B4(5:0) corresponding to even data among the data RA(5:0), RB(5:0), GA(5:0), GB(5:0), BA(5:0) and BB(5:0) output from the first divider 20.

As described above, the data RA(5:0), RB(5:0), GA(5:0), GB(5:0), BA(5:0) and BB(5:0) output from the first divider 20 is divided by 2 in the sub-dividers 31, 32, 33, 34, 35 and 36 of the second divider 30. To simplify the description, the division of the data RA(5:0) will be described as an example and it is assumed that the other data undergoes the same operation.

Figure 7:
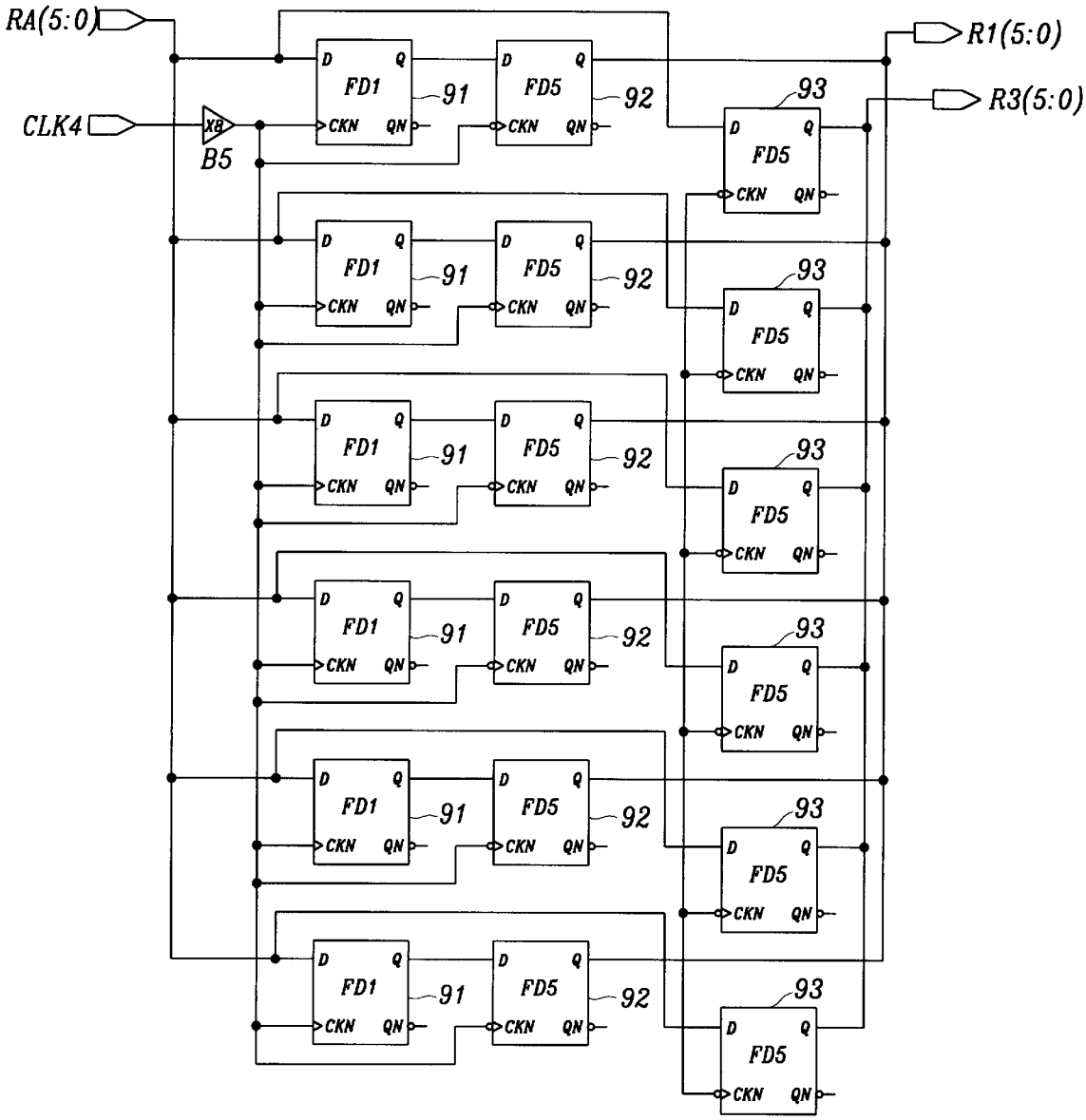
FIG. 7 is a detailed view of one divider shown in FIG. 6.
Figure 8:
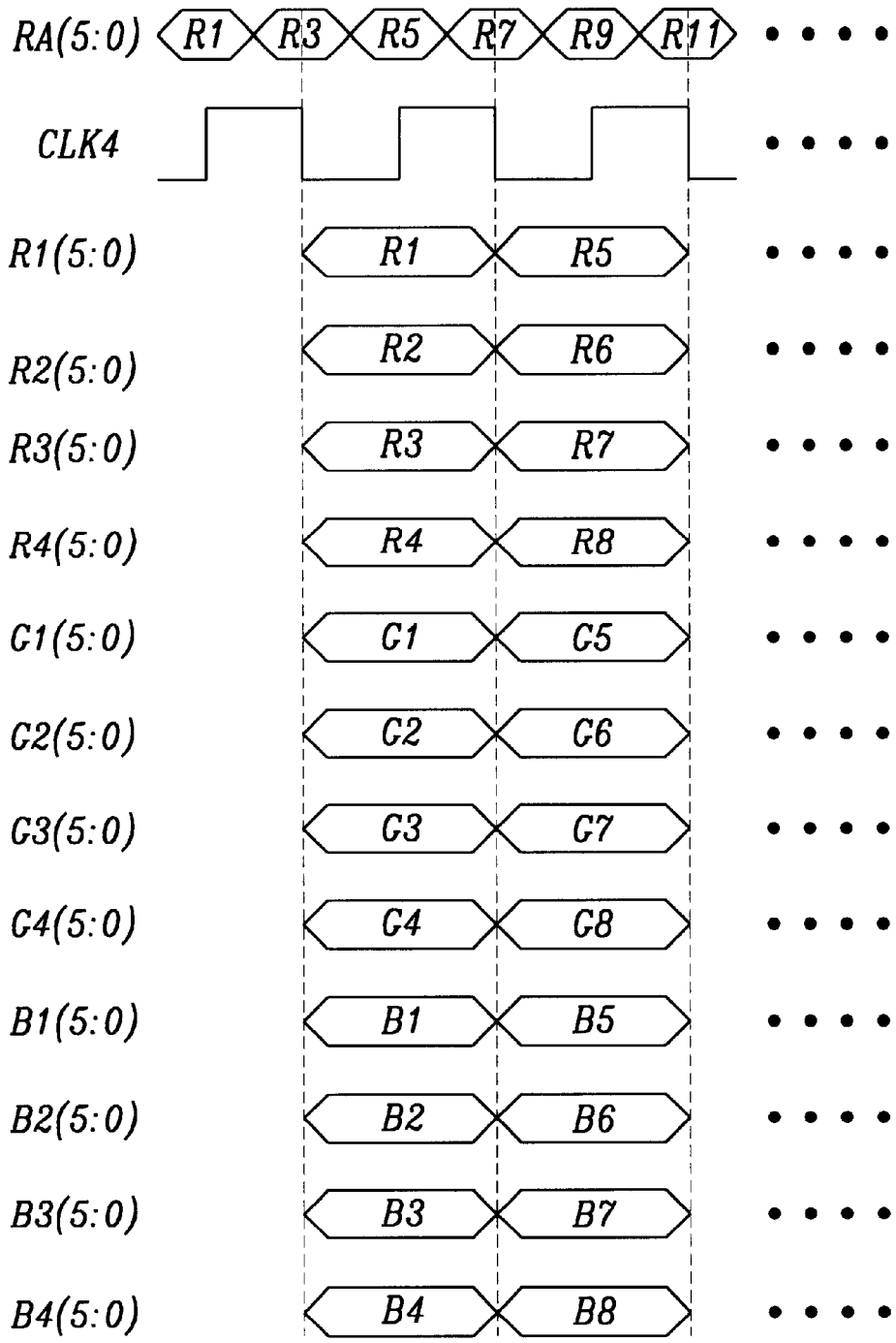
FIG. 8 is a timing chart of each element of FIG. 6.

With reference to FIG. 7, the input data RA(5:0) is output from the first flip flop 91 to the second flip flop 92 at a rising edge of the second clock signal CLK4, and is output from the second flip flop 92 at a falling edge of the same. A waveform of the output signal R1(5:0) is shown in FIG. 8. Further, the input data RA(5:0) is output to the third flip flop 93 at the falling edge of the second clock signal CLK4. The waveform of the output signal R3(5:0) is shown in FIG. 8. The other input data RB(5:0), GA(5:0), GB(5:0), BA(5:0) and BB(5:0) is also divided by 2 as described above.

Figure 9:
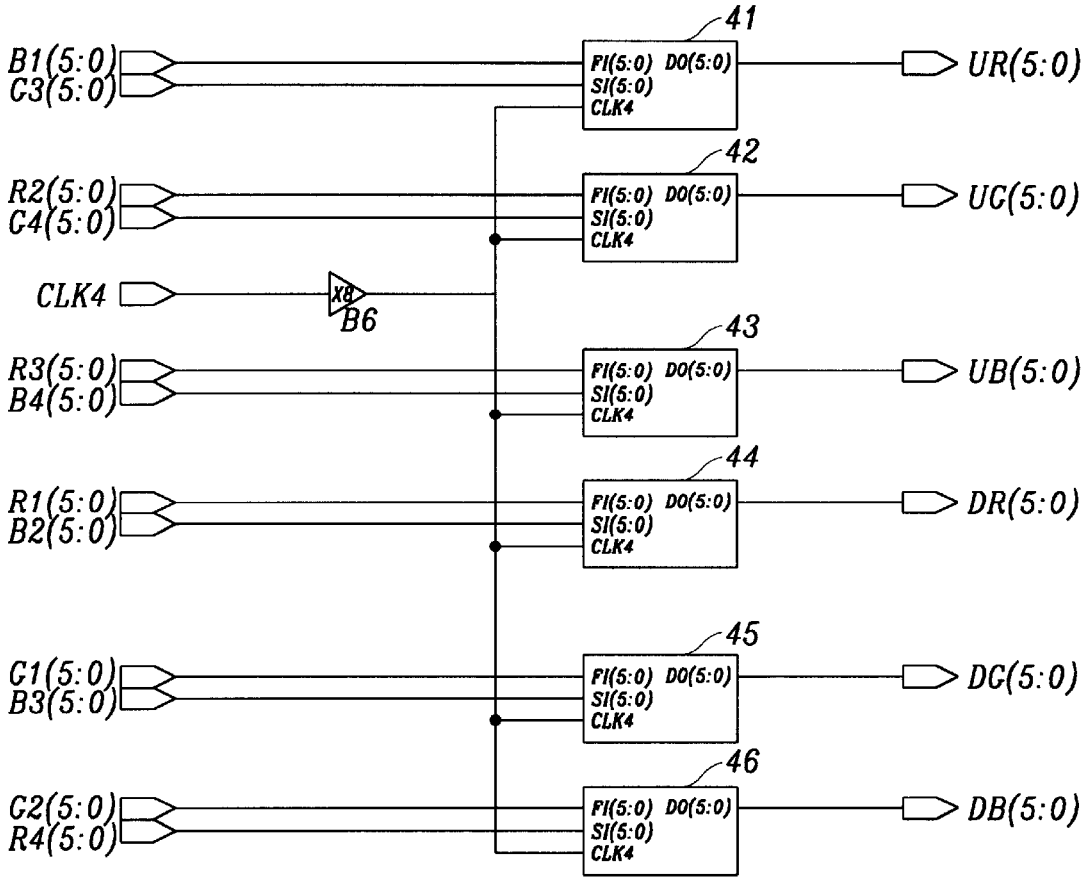
FIG. 9 is a detailed view of a data selector shown in FIG. 2.

Next, the data RA(5:0), RB(5:0), GA(5:0), GB(5:0), BA(5:0) and BB(5:0) divided in the second divider having the waveforms as shown in FIG. 8 is input to each selector 41, 42, 43, 44, 45 and 46 of the data selector 40. This will be described in more detail hereinafter with reference to FIG. 9. As shown in FIG. 9, the data selector 40 comprises a first selector 41 which receives from the second divider 30 every other odd data of data B starting from a first odd data, i.e. data B1(5:0), (B(4n−3): B1, B5, B9 . . . ) corresponding to an order of a first a fifth, a ninth . . . data, and every other odd data of data G starting from a second odd data G3(5:0), (G(4n−1):G3, G7, G11 . . . ) corresponding to an order of a third seventh, a ninth . . . data, and alternately outputs the two input data according to the state of the second clock signal CLK4; a second selector 42 which receives from the second divider 30 every other even data of data R starting from a first even data, i.e. data R2(5:0), (R(4n−2: R2, R6, R10 . . . ) corresponding to an order of a second, sixth, a tenth . . . data, and every other even data of data G starting from a second even data, i.e. data G4(5:0), (G(4n): G4, G8, G12 . . . ) corresponding to an order of a fourth, an eighth, a twelfth . . . data, and alternately outputs the two input data according to the state of the second clock signal CLK4; a third selector 43 which receives from the second divider 30 every other odd data of data R starting from a second odd data, i.e. data R3(5:0), (R4n−1) R3, R7, R1 . . . ) corresponding to an order of a third, a seventh, an eleventh . . . data, and every other even data of data B starting from a second even data, i.e. data B4(5:0), (B(4n): B4, B8, B12 . . . ) corresponding to an order of a fourth, an eighth, a twelfth . . . data, and alternately outputs the two input data according to the state of the second clock signal CLK4; a fourth selector 44 which receives from the second divider 30 every other odd data of data R starting from a first odd data, i.e. data R1(5:0), (R4n−3: R1, R5, R9 . . . ) corresponding to an order of a first, a fifth, a ninth . . . data, and every other even data of data B starting from a first even data, i.e. data B2(5:0), B4n−2: B2, B6, B10 . . . ) corresponding to an order of a second, a sixth, a tenth . . . data, and alternately outputs the two input data according to the state of the second clock signal CLK4; a fifth selector 45 which receives from the second divider 30 every other odd data of data G starting from a first odd data, i.e. data G1(5:0), (G4n−3: G1, G5, G9 . . . ) corresponding to an order of a first, a fifth, a ninth . . . data, and every other odd data of data B starting from a second odd data, i.e. data B3(5:0), (B4n−1: B3, B7, B11 . . . ) corresponding to an order of a third, a seventh, a ninth . . . data, and alternately outputs the two input data according to the state of the second clock signal CLK4; and a sixth selector 46 which receives from the second divider 30 every other even data of data G starting from a first even data, i.e. data G2(5:0), (G4n−2: G2, G6, G10 . . . ) corresponding to an order of a second, a sixth, a tenth . . . data, and every other even data of data R starting from a second even data, i.e. data R4(5:0), (R(4n): R4, R8, R12 . . . ) corresponding to an order of a fourth, an eighth, a twelfth . . . data, and alternately outputs the two input data according to the state of the second clock signal CLK4.

Regarding the input of data, as shown in FIG. 9, B1(5:0) and G3(5:0) are input to the first selector 41, R2(5:0) and G4(5:0) are input to the second selector 42, R3(5:0) and B4(5:0) are input to the third selector 43, R1(5:0) and B2(5:0) are input to the fourth selector 44, G1(5:0) and B3(5:0) are input to the fifth selector 45, and G2(5:0) and R4(5:0) are input to the sixth selector 46. The operation of the first selector 41 will be described in detail with reference to FIG. 10. The rest of the selectors are structured and operate in the same fashion.

Figure 10:
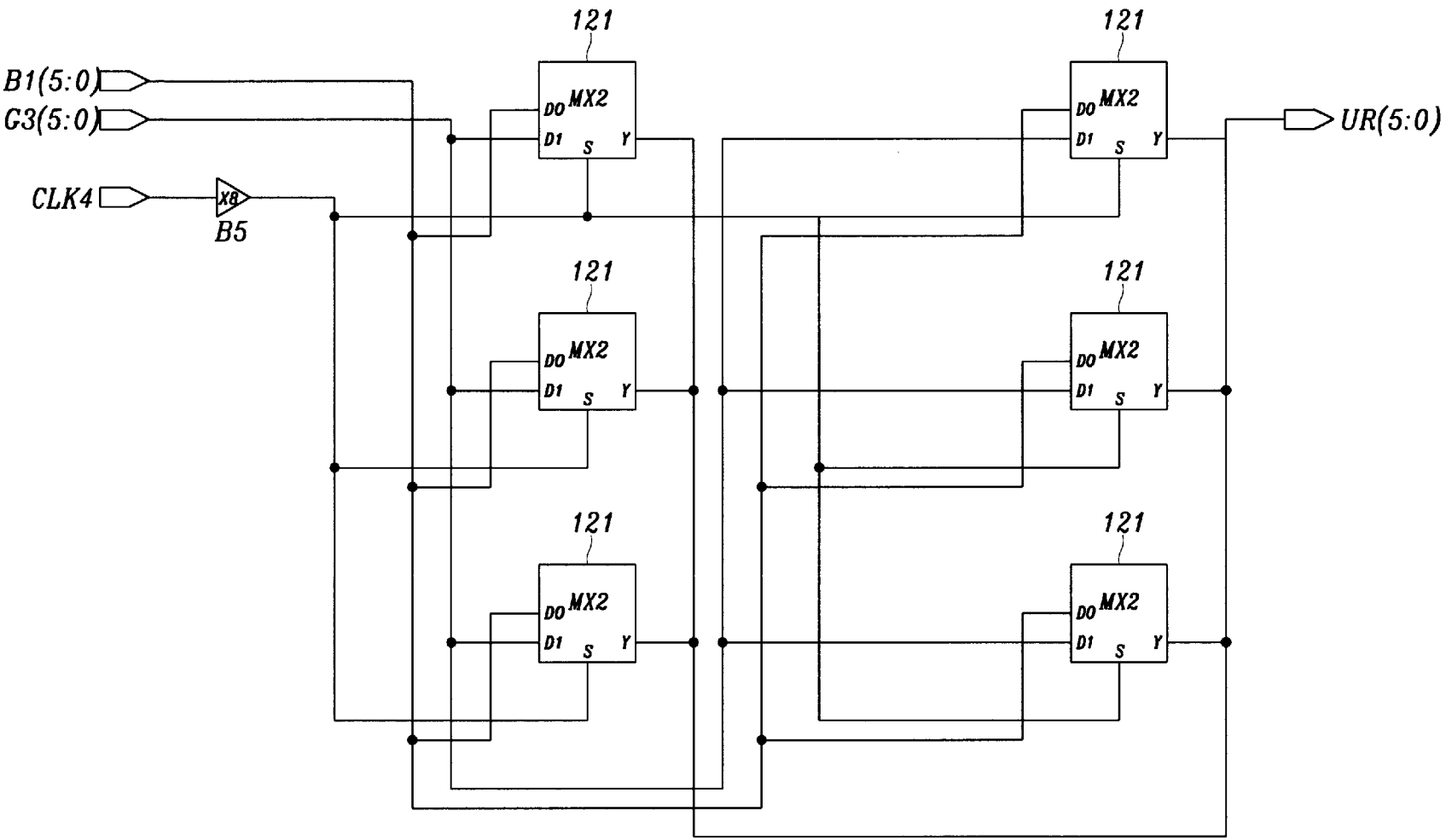
FIG. 10 is a detailed view of one selector shown in FIG. 9.
Figure 11:
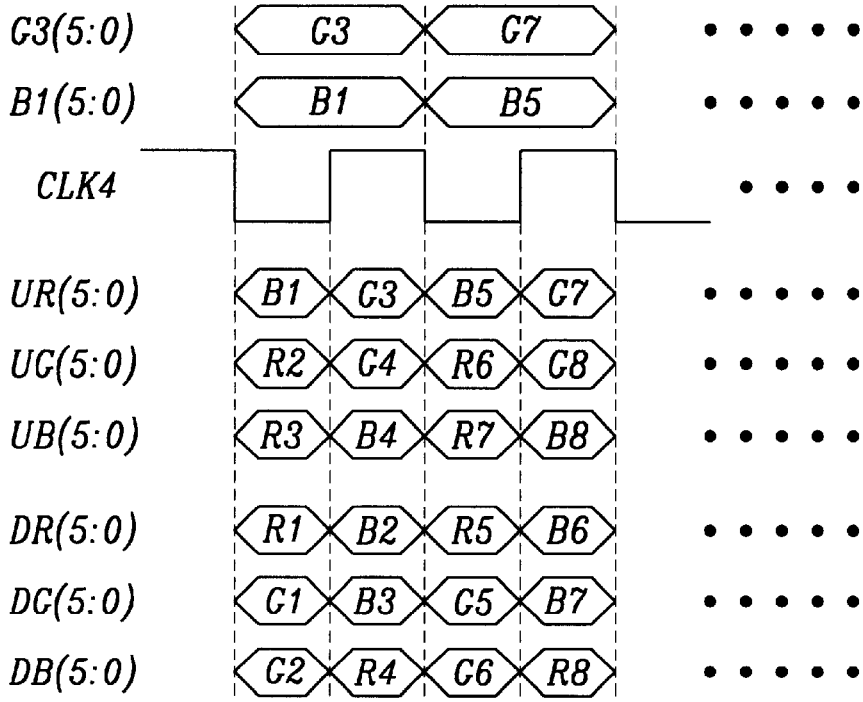
FIG. 11 is an output timing chart of FIG. 9.

As shown in FIG. 10, the first selector 41 includes six (6) multiplexers 121. Regarding the operation of the first selector 41, the two data B1(5:0) and G3(5:0) are input into the multiplexers 121 simultaneously with the second clock signal CLK4. Accordingly, the two data B1(5:0) and G3(5:0) of the first selector 41 are selectively output according to the state of the second clock signal CLK4. That is, as shown in FIG. 11, if the second clock signal CLK4 is low, B1(5:0) is output, whereas if the second clock signal CLK4 is high, G3(5:0) is output. At this time, an output signal UR(5:0) is input to the upper data driver 220 of the LCD of the present invention.

The other data R2(5:0), G4(5:0), R3(5:0), B4(5:0), R1(5:0), B2(5:0), G1(5:0), B3(5:0), G2(5:0) and R4(5:0) are selectively output by the second, third, fourth, fifth and sixth selectors 42, 43, 44, 45 and 46. Waveforms of output signals UR(5:0), UG(5:0), UB(5:0), DR(5:0), DG(5:0) and DB(5:0) are shown in FIG. 11. Here, output signals UR(5:0), UG(5:0) and UB(5:0) are output to the upper data driver 220, whereas the output signals DR(5:0), DG(5:0) and DB(5:0) are output to the lower data driver 240.

Figure 12:
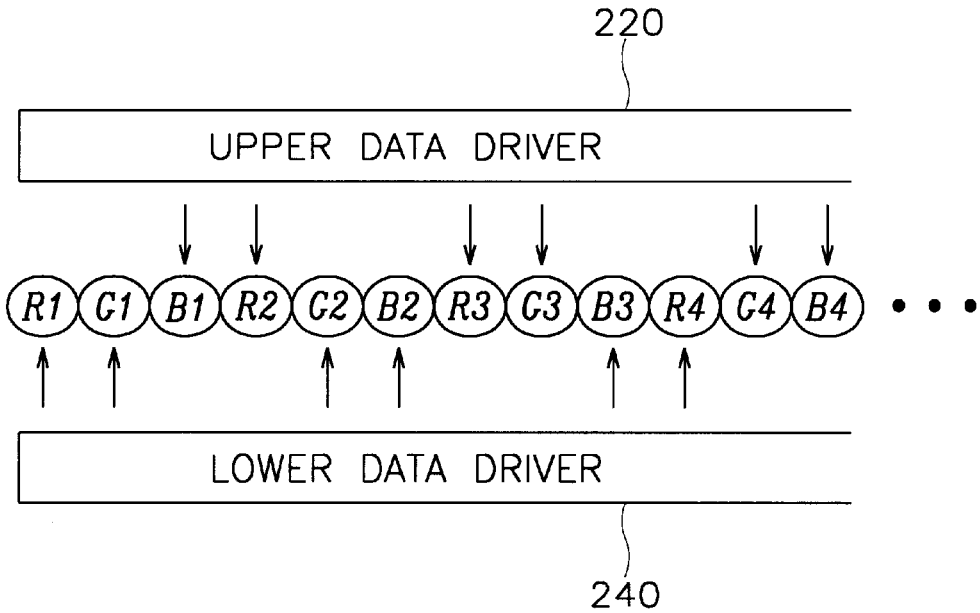
FIG. 12 is a schematic view illustrating a sequence to which data is applied to a LCD panel.

As shown in FIG. 12, the lower driver 240 and upper data driver 220 alternately invert and output two consecutive data, thereby realizing a dot inversion.

In the LCD having a dual bank data driver structure according to the present invention described above, although the data lines are alternately connected to the upper and lower data drivers in pairs of consecutive data lines, it is also possible to realize this connection in even groups of data lines, like 4, 6, and so on. In such a case, the timing signal generator applies the R,G,B signals likewise to the upper and lower data drivers.

Although a preferred embodiment of the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display, comprising:

an LCD panel including a plurality of gate lines, a plurality of data lines intersecting the gate lines, and a plurality of pixels arranged in a matrix and each having a switching element connected to the gate lines and the data lines, wherein the data lines are grouped into a plurality of data line groups and each data line group has an even number of adjacent data lines;

a gate driver successively applying a gate ON voltage to the gate lines to turn the switching elements ON;

a first data driver and a second data driver provided on opposing sides of the LCD panel, wherein the data line groups are alternately connected to the first data driver and the second data driver such that the first data driver and the second data driver respectively applies a gray voltage corresponding to an image signal to the data lines in each data line group via output terminals; and a timing signal generator that outputs timing signals to the first data driver and the second data driver, and to the gate driver, wherein the timing signal generator receives R,G,B data input in series, and after conducting a predetermined signal processing operation on the R,G,B data, transmits the processed R,G,B data to the upper and lower data drivers, thereby outputting a (4n−3)th B data and a (4n−1)th G data to data lines connected to a (6n−5)th and a (6n−2)th output terminal of the first data driver, outputting a (4n−2)th R data and a (4n)th G data to data lines connected to a (6n−4)th and a (6n−1)th output terminal of the first data driver, outputting a a (4n−1)tlh R data and a (4n)th G data to data lines connected to a (6n−3)th and a (6n)th output terminal of the first data driver, outputting a (4n−3)th R data and a (4n−2)th B data to data lines connected to a (6n−5)th and a (6n−2)th output terminal of the second data driver, outputting a (4n−3) th G data and a (4n−1)th B data to data lines connected to a (6n−4)th and a (6n−1)th output terminal of the second data driver, and outputting a (4n−2)th G data and a (4n)th R data to data lines connected to a (6n−3)th and a (6n)th output terminal of the second data driver (wherein n is a positive integer).

2. The liquid crystal display of claim 1, wherein the timing signal generator comprises:

a first divider receiving the R,G,B data input in series, and outputting a first R,G,B data each corresponding to odd R,G,B data and a second R,G,B data corresponding to odd R,G,B data;

a second divider receiving the first R,G,B data and the second R,G,B data, and outputting a third R,G,B data corresponding to every other first R,G,B data beginning with a first of the same, a fourth R,G,B data corresponding to every other first R,G,B data beginning with a second of the same, a fifth R,G,B data corresponding to every other second R,G,B data beginning with a first of the same, and a sixth R,G,B data corresponding to every other second R,G,B data beginning with a second of the same; and a data selector for selectively outputting the third, fourth, fifth and sixth R,G,B data output from the second divider to the first data driver and the second data driver, and appling the gray voltage to the data lines of the LCD panel such that the gray voltage of opposite polarity is applied to each of the adjacent data lines of each data line group.

* * * * *